US005570159A

United States Patent [19]

Hirose et al.

[11] Patent Number: 5,570,159

[45] Date of Patent: Oct. 29, 1996

[54] METHOD FOR ASSEMBLING STRUCTURAL FRAME MEMBERS OF AN IMAGE FORMING APPARATUS

[75] Inventors: Shinji Hirose, Moriyamachi; Makoto Nita, Kashiwa; Ryuichi Obata, Moriyamachi, all of Japan

[73] Assignee: Canon Kabushiki Kaisha, Tokyo, Japan

[21] Appl. No.: 420,878

[22] Filed: Apr. 13, 1995

[30] Foreign Application Priority Data

Apr. 18, 1994 [JP] Japan ..... 6-078853
Mar. 14, 1995 [JP] Japan ..... 7-054138

[51] Int. Cl.[6] ..... G03G 15/00
[52] U.S. Cl. ..... 355/200
[58] Field of Search ..... 355/200, 210, 355/211

[56] References Cited

FOREIGN PATENT DOCUMENTS 1-167159 6/1989 Japan ..... 355/200
3-33762 2/1991 Japan ..... 355/200
6-175419 6/1994 Japan ..... 355/200

*Primary Examiner*—R. L. Moses
*Attorney, Agent, or Firm*—Fitzpatrick, Cella, Harper & Scinto

[57] ABSTRACT

A structure of an image forming apparatus has first and a second side members and a holding member for supporting an optical unit. The holding member has a nearly perpendicularly bent portion on at least one edge of the holding member and a connecting portion, extended from the base of the bent portion, for connecting the first and second side members. Further, the first and second side members have openings into which the connecting portion of the holding member is inserted and elastic portions for pressing the inserted connecting portion against the openings. The holding member is aligned in its place at reference positions of the openings of the first and second side members by inserting the connecting portion of the holding member into the openings of the first and second side members.

18 Claims, 14 Drawing Sheets

FIG. 10

| REASONS OF UNEVENNESS | | BEFORE IMPROVEMENT (CONVENTIONAL FITTING) | AFTER IMPROVEMENT (NEW FITTING) |
|---|---|---|---|
| UNEVENNESS OF PARTS INSIDE SCANNER | | ±6.61 | ±6.61 |
| UNEVENNESS OF MAIN BODY FRAME | FITTING A (SIDE PLATE / UPPER HOLDING MEMBER) | 0.15 | 0 |
| | PRECISION OF SIDE PLATE | 0.10 | 0.10 |
| | FITTING B (SIDE PLATE / DRUM BEARING) | 0.05 | 0.05 |
| | FITTING C (DRUM BEARING / DRUM SHAFT) | 0.05 | 0.05 |
| | PRECISION OF DIAMETER OF DRUM | 0.10 | 0.10 |
| TOTAL TORELANCE (PREDETERMINED : LESS OR EQUAL TO 7mm) | | ±7.06 | ±6.91 |

METHOD FOR ASSEMBLING STRUCTURAL FRAME MEMBERS OF AN IMAGE FORMING APPARATUS

BACKGROUND OF THE INVENTION

The present invention relates to a method for assembling structural frame members of an image forming apparatus such as an optical device, office automation devices, especially, a copy machine and a laser beam printer (LBP) and, more particularly, to a structure which includes such units as an optical unit, a fixing unit, and a transfer unit arranged in a frame of a main body structure.

Conventionally, there is a widely known method of assembling a plate metal structure, such as a main body frame of an image forming apparatus, e.g., an optical device, a copy machine, and a LBP, requiring certain precision in which plate metal members consisting the plate metal structure are assembled in position using an exclusive assembly set-up member and, subsequently, the metal members are fixed to each other with screws or by welding.

FIG. 16 is a figure showing a frame of a main body structure of an image forming apparatus, such as a copy machine.

In a conventional structure, when supporting members 166, 164, and 162 for supporting an optical unit, a transfer unit, and a fixing unit provided inside of side plate members 168 and 170, and not-shown bottom and top plate members are assembled and combined by screws, each aforesaid member is set in its position by a position deciding means, such as a cylinder unit 154 on an assembly set-up member 150, fixed in its position by a clamp 152, and then combined.

More specifically, each member is set and kept in its position on the assembly set-up member 150, the supporting members are then combined by tightening screws 172 (about 40 screws, and the number depends upon the type of an apparatus). Then, the completed main body frame is taken off from the assembly set-up member 150.

Thereby, the main body frame, and the like, of the image forming apparatus can be assembled in a high degree of tolerance.

However, there are the following problems in the aforesaid conventional method when productivity is concerned.

(1) Since the assembly set-up member is a large, complicated, exclusive and special member, the cost for equipment is high.

(2) When an assembling system is automated by using a screw-tightening device or the like, it consumes extra time to change the assembly set-up members for the assembling system, thus reducing productivity.

(3) When the aforesaid main body frame of the image forming apparatus is to be assembled, the tolerance degree of adjusting the relative position (distance) between the main body frame and each unit, e.g., especially an optical unit, relates to the clearness and resolution of a focused image of an original image formed on an electrostatic drum, and affects the quality of the printed image.

(4) Regarding the transfer unit and the fixing unit, when an image is transferred from an electrostatic drum to a transfer paper sheet, it is necessary to accomplish adjustment of the distances from a reference position of the electrostatic drum (the central axis of the electrostatic drum) to reference positions of each unit in a high degree of tolerance.

SUMMARY OF THE INVENTION

The present invention has been made in consideration of the above situation, and has as its object to provide a structure of an image forming apparatus which can be assembled in a high degree of tolerance without using an assembly set-up member or the like.

According to a first aspect of the present invention, the foregoing object is attained by providing a structure of an image forming apparatus which has at least an optical unit, comprising: a first side member; a second side member; and a holding member for supporting the optical unit, wherein the holding member has a nearly perpendicularly bent portion on at least one edge of the holding member and a connecting portion, extended from the base of the bent portion, for connecting the first and second side members, and wherein the first and second side members have openings into which the connecting portion of the holding member is inserted and an elastic portion for pressing the inserted connecting portion against the openings, further wherein the holding member is aligned in place at reference positions of the openings of the first and second side members by inserting the connecting portion of the holding member into the openings of the first and second side members.

According to a second aspect of the present invention, the foregoing object is also attained by providing a structure of an image forming apparatus which has at least an image transfer unit, comprising: a first side member; a second side member; and a holding member for supporting the image transfer unit, wherein the holding member has a nearly perpendicularly bent portion on at least one edge of the holding member and a connecting portion, extended from the base of the bent portion, for connecting the first and second side members, and wherein the first and second side members have openings into which the connecting portion of the holding member is inserted and an elastic portion for pressing the inserted connecting portion against the openings, further wherein the holding member is aligned in place at reference positions of the openings of the first and second side members by inserting the connecting portion of the holding member into the openings of the first and second side members.

According to a third aspect of the present invention, the foregoing object is also attained by providing a structure of an image forming apparatus which has at least an image fixing unit, comprising: a first side member; a second side member; and a holding member for supporting the image fixing unit, wherein the holding member has a nearly perpendicularly bent portion on at least one edge of the holding member and a connecting portion, extended from the base of the bent portion, for connecting the first and second side members, and wherein the first and second side members have openings into which the connecting portion of the holding member is inserted and elastic portions for pressing the inserted connecting portion against the openings, further wherein the holding member is aligned in place at reference positions of the openings of the first and second side members by inserting the connecting portion of the holding member into the openings of the first and second side members.

According to a fourth aspect of the present invention, the foregoing object is also attained by providing a structure of an image forming apparatus which has an optical unit inside of a main body, comprising: a pair, right and left side, of members; and a holding member, placed between the pair of right and left side members, for supporting the optical unit, wherein the holding member has a bent portion at at least one edge of the holding member, and a connecting portion extended from the bent portion, and wherein the pair of right and left side members have openings into which the connecting portion of the holding member is inserted, and pressing portions for pressing the connecting portion against the openings when the connecting portion is inserted into the openings.

According to a fifth aspect of the present invention, the foregoing object is also attained by providing a structure of an image forming apparatus which has an image transfer unit inside of a main body, comprising: a pair of right and left side members; and a holding member, placed between the pair of right and left side members, for supporting the image transfer unit, wherein the holding member has a bent portion at at least one edge of the holding member and a connecting portion extended from the bent portion, and wherein the pair of right and left side members have openings into which the connecting portion of the holding member is inserted, and pressing portions for pressing the connecting portion against the openings when the connecting portion is inserted into the openings.

According to a sixth aspect of the present invention, the foregoing object is also attained by providing a structure of an image forming apparatus which has an image fixing unit inside of a main body, comprising: a pair of right and left side members; and a holding member, placed between the pair of right and left side members, for supporting the image fixing unit, wherein the holding member has a bent portion at at least one edge of the holding member and a connecting portion extended from the bent portion, and wherein the pair of right and left side members have openings into which the connecting portion of the holding member is inserted, and pressing portions for pressing the connecting portion against the openings when the connecting portion is inserted into the openings.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 10 is a table showing differences of tolerance of each part in the main body frame between a conventional example and the embodiment;

DETAILED DESCRIPTION OF THE PREFERRED EMBODIMENTS

Preferred embodiment of the present invention will be described in detail in accordance with the accompanying drawings.

Figure 1:
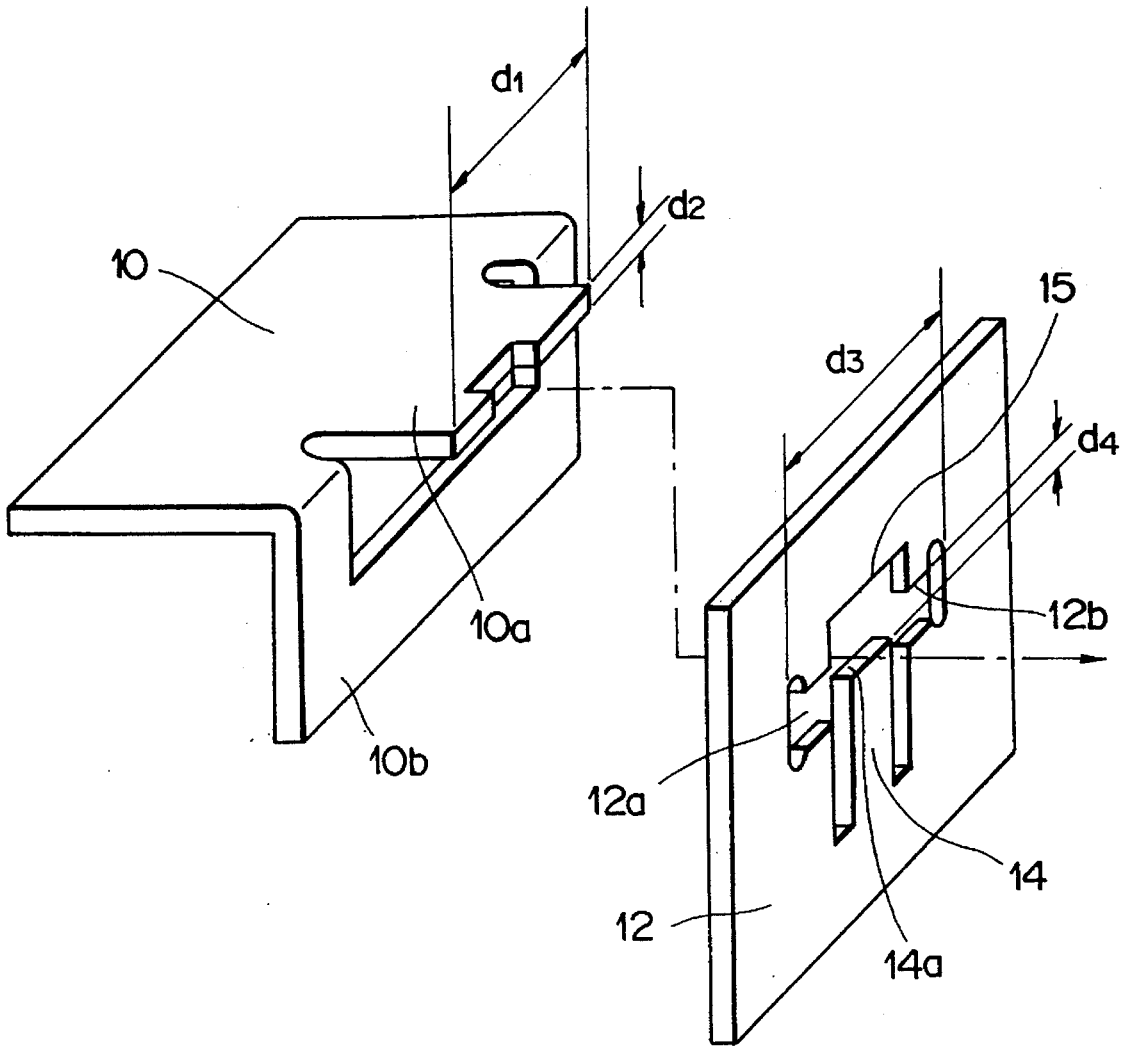
FIG. 1 is a figure illustrating that two plate metal members are combined by employing a combining method according to an embodiment.
Figure 2:
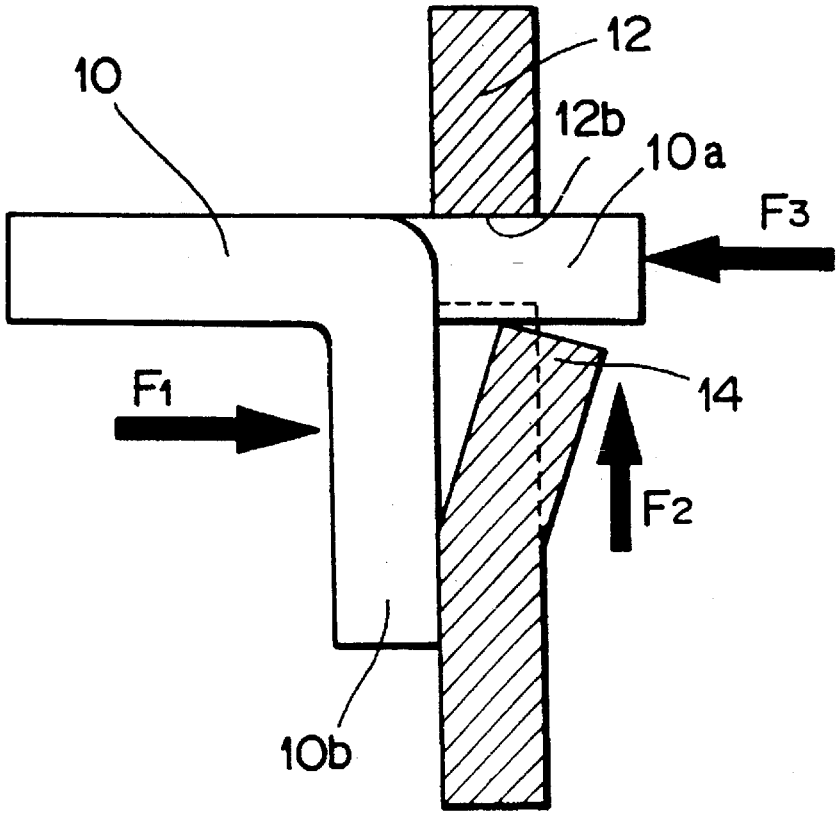
FIG. 2 is a figure illustrating that two plate metal members are combined by employing the combining method according to the embodiment.

FIGS. 1 and 2 are diagrams illustrating that two plate metal members used in a structure of an image forming apparatus are combined according to the embodiment. FIG. 1 shows the plate metal members before being combined, and FIG. 2 shows the plate metal members after being combined.

In FIG. 1, a connecting portion 10*a* of width d1 is formed in a first plate metal member 10 (corresponds to a supporting member of the main body frame of the image forming apparatus). Around the connecting portion 10*a*, there is formed a position deciding portion 10*b* which touches a surface of a second plate metal member 12 (corresponds to a side plate of the main body frame of the image forming apparatus) that is, the member to be combined with the first plate metal member 10. Further, the first plate metal member 10 thickness is d2.

Whereas, a nearly rectangular shaped opening 12*a* having width of d3, into which the connecting portion 10*a* is pressed in, is formed in the second plate metal member 12 used as a position reference. An upper surface 12*b* of the opening 12*a* is to touch an upper surface of the connecting portion 10*a*, and becomes a reference surface for determining the position of the first plate metal member 10 in the second plate metal member 12 in the vertical direction. Further, a pressing portion 14 extended from a lower portion into the opening 12*a*, is formed in the second plate metal member 12. The distance between an upper surface 14*a* of the pressing portion 14 and the upper surface 12*b* of the opening 12*a* is set to d4 which is slightly less than the thickness d2 of the first plate metal member 10. Note, a general shearing tolerance for a plate metal member is enough for the tolerance of the width d4.

In the center of the upper surface 12*b* of the opening 12*a*, a concave portion 15 is formed. Without the concave portion 15, it requires stricter precision of a press shearing member to press and process the opening 12*a* in the second plate metal member 12 in order to make the connecting portion 10*a* of the first plate metal member 10 touch the entire pressing surface 12*b* (upper surface of the opening 12*a*).

This increases manufacturing cost. On the contrary, by making the central portion of the pressing surface 12*b* indented, the requirement of precision of the press shearing member becomes less, which makes it easier to process the opening 12*a*, thereby lowering the manufacturing cost.

Figure 17:
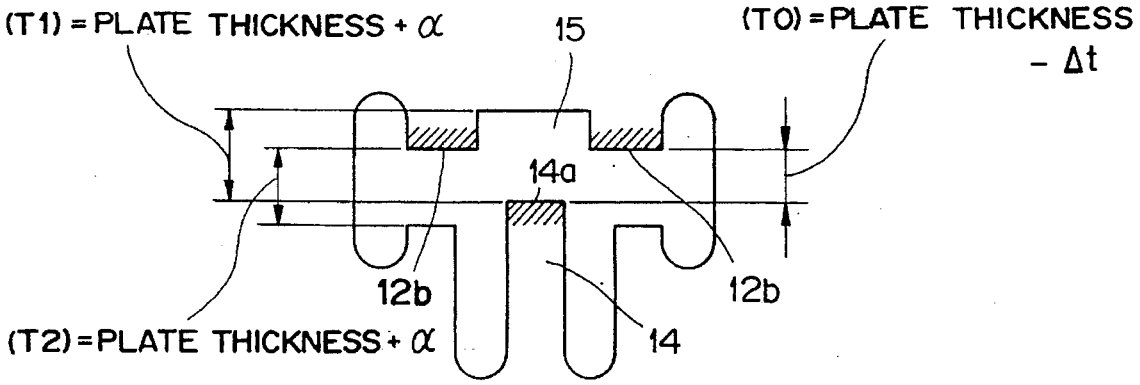
FIG. 17 is a flat view showing a shape of an opening of a second plate metal member.

The above will be explained in more detail. In general press-processing, it is considered impossible to make a hole whose width is narrower than the thickness of the plate metal. Even if it is possible, it is not suitable from manufacturing quantity for the manufacturing cost standpoint. However, in the embodiment, it is necessary to make the distance between the upper surface 14*a* of the pressing portion 14 and the pressing surface 12*b*, T0, narrower than the plate thickness as shown in FIG. 17, and to bend the pressing portion 14. Therefore, in the embodiment, the concave portion 15 is formed in the center of the pressing surface 12*b*, the distance between the concave portion 15 and the upper surface 14*a* of the pressing portion 14, T1, is made larger than the plate thickness, and the divided pressing surfaces 12*b*, divided by the concave portion 15, are arranged in the right and left positions and the distances to surfaces opposing the pressing surfaces 12*b* in the opening 12*a* are lowered (distance T2). Accordingly, the cost for the press-processing can be reduced.

After the first and the second plate metal members 10 and 12 are processed as above, by pressing the connecting portion 10*a* into the opening 12*a* with force F1, as shown in FIGS. 1 and 2, these plate metal members 10 and 12 are combined. At this time, only the pressing member 14 is deformed so as to adjust to the plate thickness of the first plate metal member 10, thereby two plate metal members are connected. It should be noted that, when a general thin surface-processed metal plate, such as a chromating metal plate, is used, spring back force remains in the pressing portion 14, therefore, both force F2 for pressing members and force F3 to connect the members act at the same time. The relationship of the acting force F1, F2 and F3 has F1<F3<F2 characteristics.

The positions of the first plate metal member 10 and the second plate metal member 12 in the vertical direction with respect to the paper sheet surface on which FIG. 2 is illustrated are decided by fitting the connecting portion 10*a* of width d1 in the opening 12*a* of width d3. Further, the positions in the right and left direction are decided by touching the position deciding portion 10*b* and the surface of the second plate metal member 12. Therefore, both the plate metal members 10 and 12 are connected in the state where the positions of the plate metal members 10 and 12 are decided in high precision.

Then, by fixing the plate metal members with screws or the like in a state where the plate metal members 10 and 12 are aligned in high precision, as described above, the main body frame of an optical device and an image forming apparatus is completed.

Next, assembling the main body frame of a laser beam printer (LBP) by applying the above-described method will be explained.

Before explaining how to apply the aforesaid method of the embodiment to the LBP, the principle of the printing method by a LBP will be described.

Figure 3:
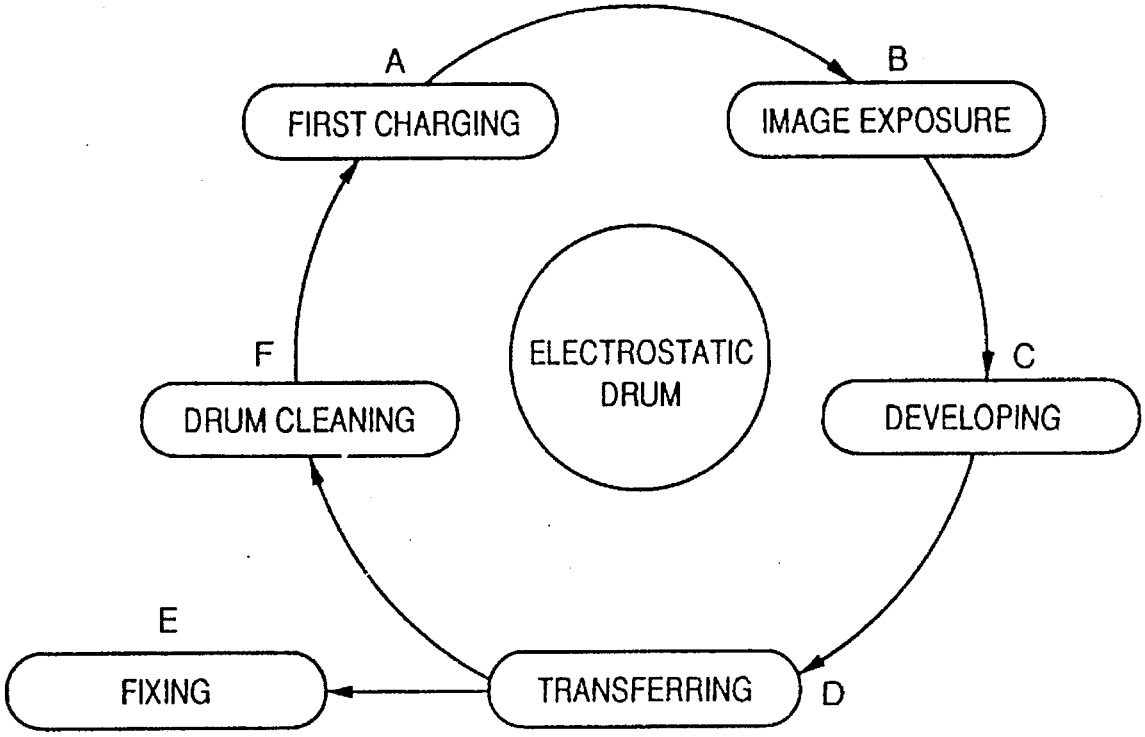
FIG. 3 is a figure explaining the basic process of an electrophotographic technique.
Figure 4:
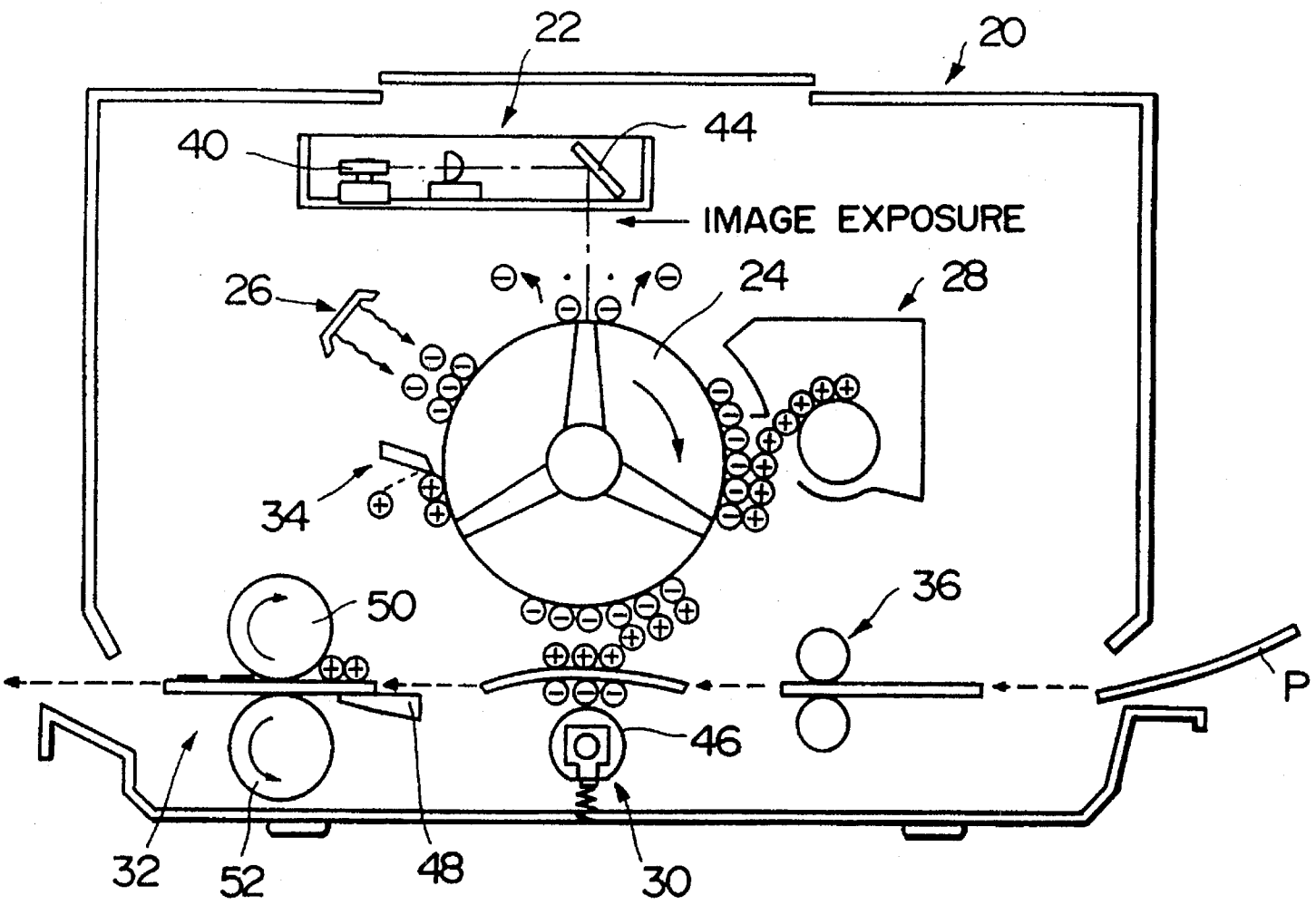
FIG. 4 is a cross sectional view showing a basic structure of a laser beam printer (LBP)
Figure 5:
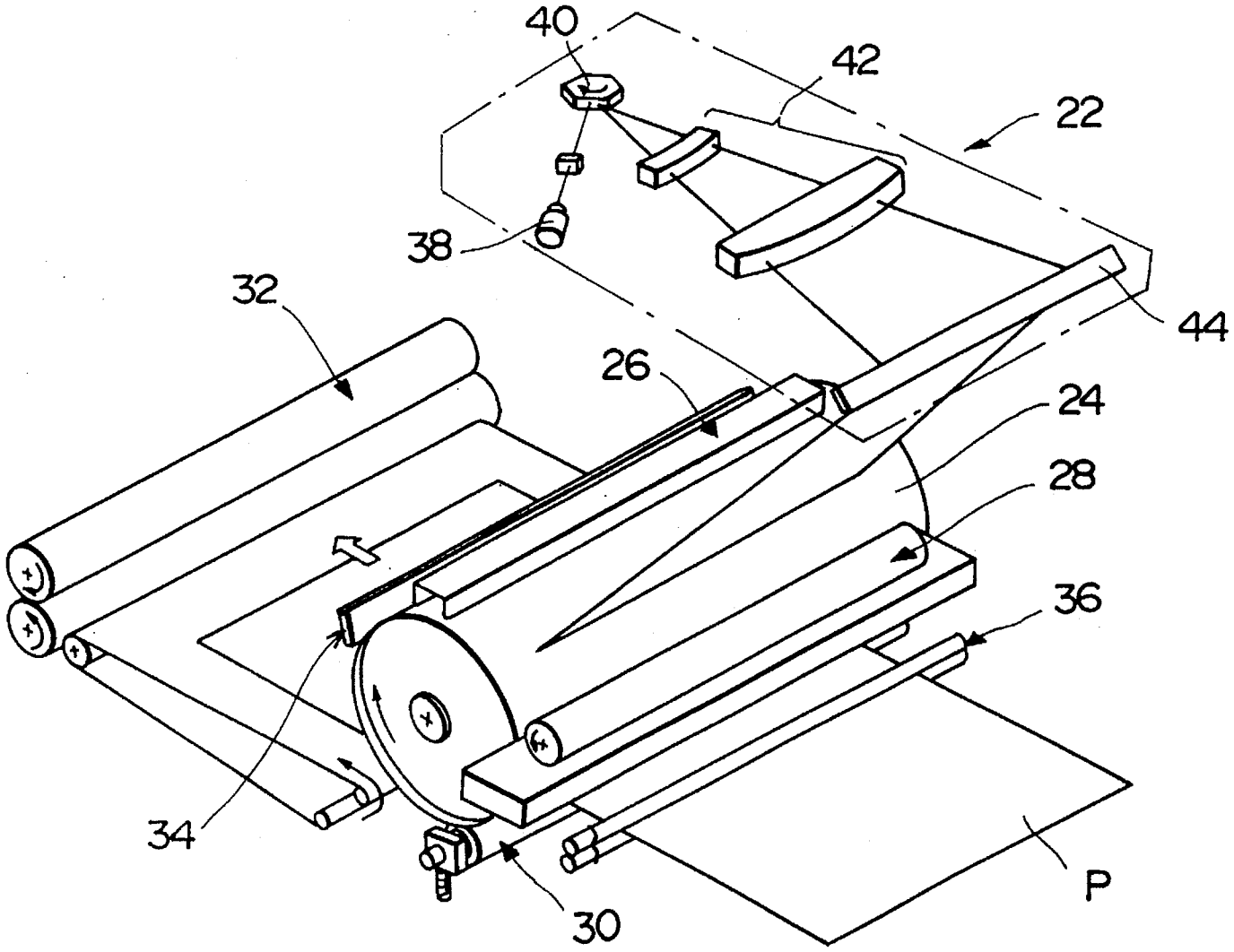
FIG. 5 is an external view illustrating a basic structure of a LBP.

FIG. 3 is a figure for explaining a basic process of an electrophotography, FIG. 4 is a cross sectional view showing a basic structure of a LBP, and FIG. 5 is an external view illustrating a basic structure of a LBP.

Referring to FIGS. 4 and 5, a LBP 20 basically comprises a scanner unit 22 for scanning with a laser beam in accordance with input image data, an electrostatic drum 24 for receiving the laser beam emitted from the scanner unit 22, a first charging unit 26 for charging the electrostatic drum 24 uniformly, a developing unit 28 to cause the portion of the electrostatic drum 24 where the beam is incidented to attract toner, a transfer unit 30 for transferring the toner on the electrostatic drum 24 to a copying paper sheet P, and a fixing unit 32 for fixing the toner transferred to the copying paper sheet P. In addition, the LBP 20 also has a drum cleaning unit 34 for removing the toner remaining on the electrostatic drum 24 after the transfer to the copying paper sheet P, a resist roller 36 for leading the copying paper sheet P, a conveying function for conveying the copying paper sheet P from the transfer unit 30 to the fixing unit 32, and so on.

The scanner unit 22 comprises a laser beam source 38 which emits the laser beam based on the input image data, a polygon mirror 40 for reflecting the laser beam from the laser beam source 38 to scan, an optical element 42 for converging the laser beam reflected by the polygon mirror 40, and a mirror 44 for reflecting the laser beam transmitted through the optical element 42 to the electrostatic drum 24 provided below the scanner unit 22.

Referring to FIGS. 3 to 5, a process of printing on the copying paper sheet by using the LBP constructed as above is explained.

As for the basic process of an electrophotography, first, uniform charge is applied to the electrostatic drum 24 by the first charging unit 26 (first charging process). Second, an image to be printed is exposed on the electrostatic drum 24, then by discharging the portions where light is incidented, an electrical image (latent image) is formed on the electrostatic drum 24 (image exposing process). If a LBP is used, laser beam incidents on the electrostatic drum 24 will form character portions, thereby forming a latent image. Next, charge on the electrostatic drum 24 incidented to the laser beam is made to attract toner (resin powder) charged with the electrostatically opposite charge. Accordingly, a visual image is formed on the electrostatic drum 24 (developing process). Then, the copying paper sheet P is placed between the electrostatic drum 24 and a transfer roller 46 of the transfer unit 30, and the transfer roller 46 attracts the toner on the electrostatic drum 24. Thereby, the image is transferred to the copying paper sheet P (transfer process). The copying paper sheet P on which an image is transferred is sent to the fixing unit 32 which has a fixing roller 50 via a conveying unit along a fixing entrance guide 48 (sheet conveyance process). Since the toner on the copy paper sheet P is electrically attached to the copy paper sheet, in order to strengthen the combined force, the copying paper sheet P is conveyed between a pressing roller 52 (lower side) and the fixing roller 50 (disposed on upper side and composed of heating element), while applying with pressure, thus the toner is melted and fixed on the copying paper sheet P.

This is a brief general processing description of an electrophotography. When the combining method according to the embodiment is applied to the main body frame of such a LBP 20, position precision between the electrostatic drum 24 and the scanner unit 22, between the electrostatic drum 24 and the transfer roller 46, and between the fixing entrance guide 48 and the fixing roller 50 are improved, thereby the quality of printing becomes stable as well as the non-adjusted assembly of the main body frame is realized.

Figure 6:
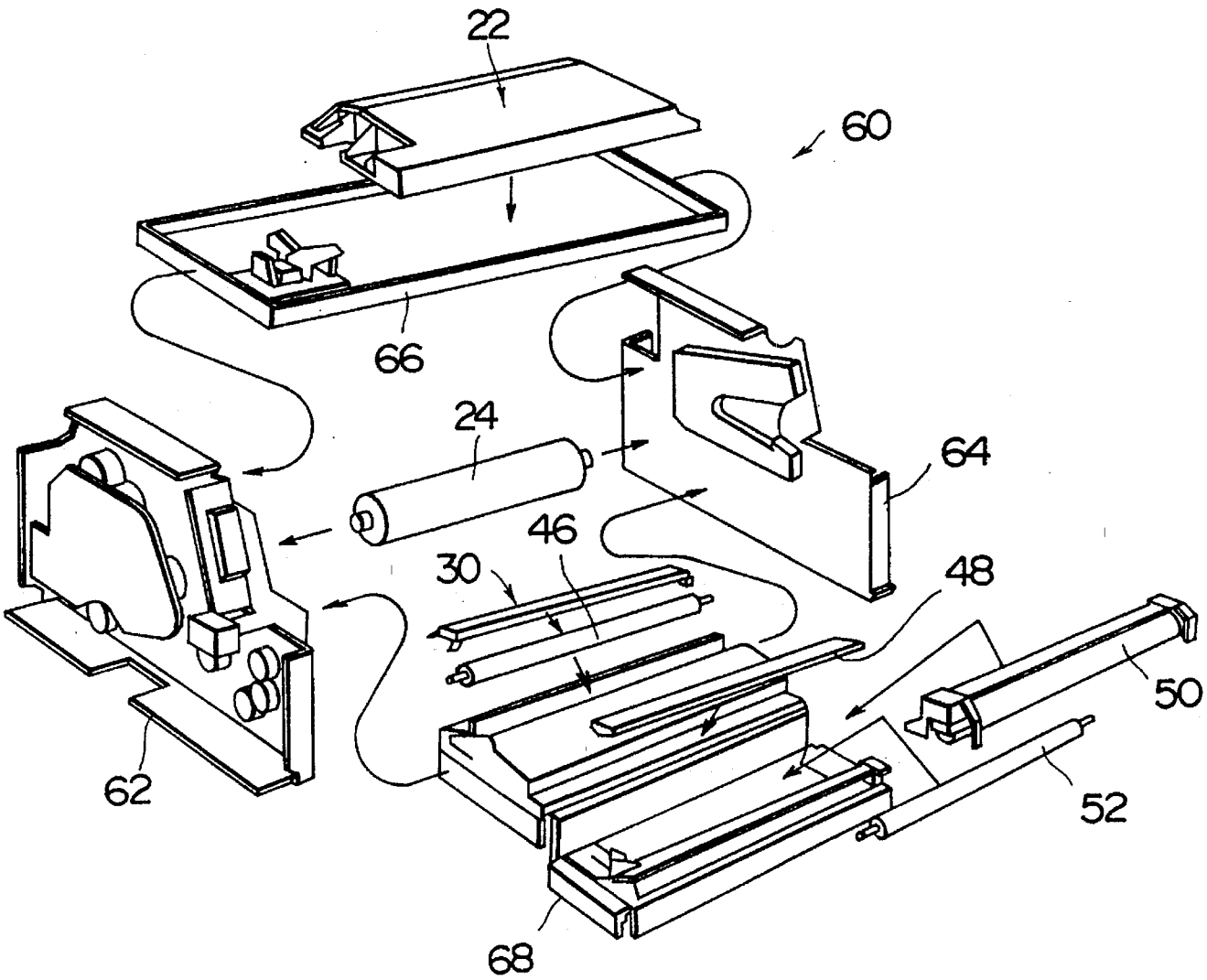
FIG. 6 is a breakout view showing a structure of a main body frame of the LBP to be applied with the combining method according to the embodiment.
Figure 7:
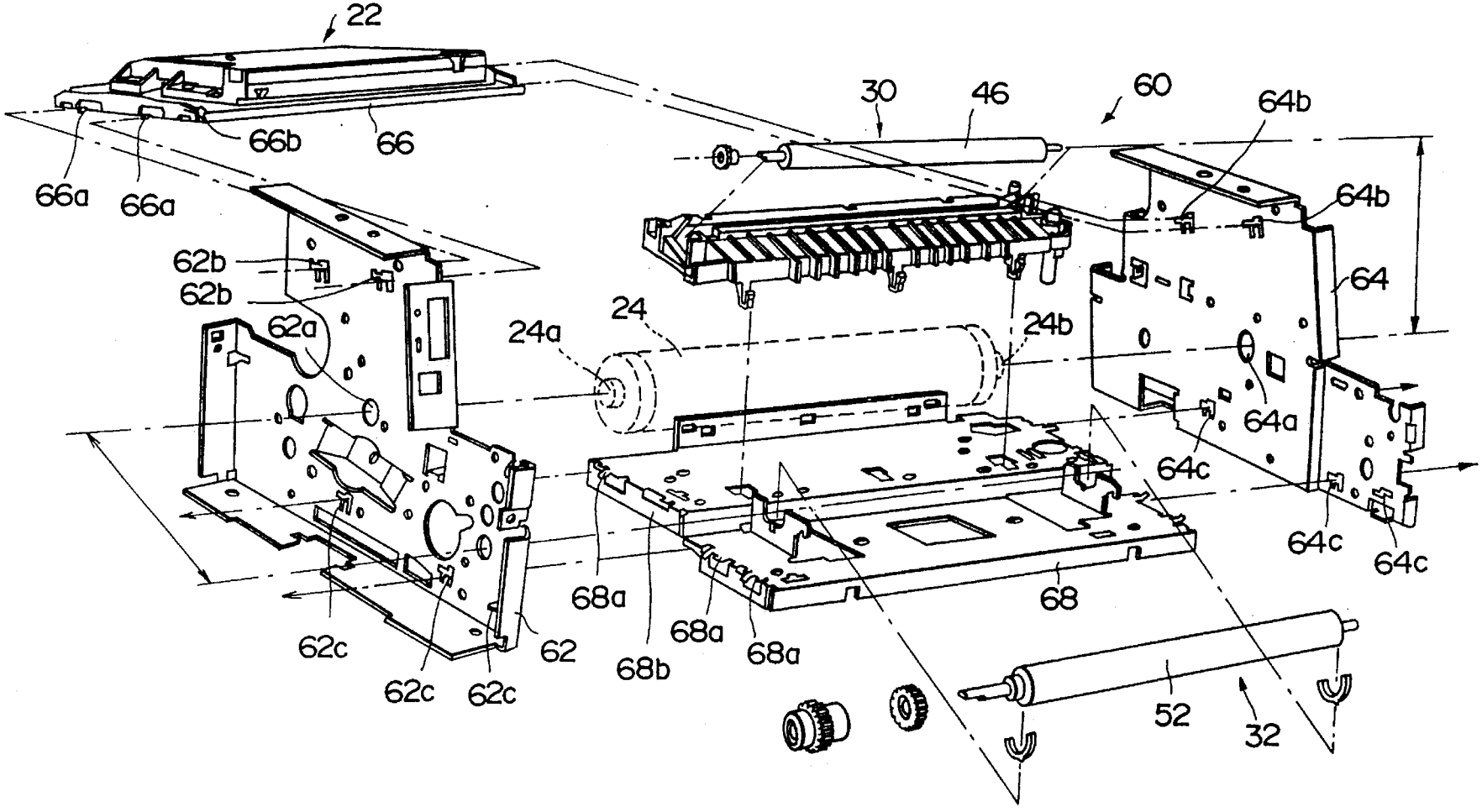
FIG. 7 is a partial view of the main part of FIG. 6.

FIG. 6 is a breakout view showing a structure of a main body frame 60 of the LBP 20 applied with a combining method of the embodiment, and FIG. 7 is a figure showing a main part of FIG. 6.

In FIGS. 6 and 7, the main body frame 60 basically comprises side plates 62 and 64 provided perpendicularly, an upper holding member 66 supported between the side plates 62 and 64 in the upper part, and a lower holding member 68 supported between the side plates 62 and 64 in the lower part. The upper holding member 66 is supported by the side plates 62 and 64 in a state where it slightly inclines toward the front side, and the lower holding member 68 is supported by the side plates 62 and 64 in a state where it is almost horizontal. A scanner unit 22 is disposed on the upper holding member 66, and the transfer unit 30, the fixing roller 50, and the pressing roller 52 are provided on the lower holding member 68. Further, the electrostatic drum 24 is directly supported by the side plates 62 and 64 so that it can rotate freely by putting its rotational shaft extending from its sides 24*a* and 24*b* into holding holes 62*a* and 64*a* in the side plates 62 and 64.

In the main body frame 60 constructed as above, the upper holding member 66 and the lower holding member 68 are attached to the side plates 62 and 64 in the aforesaid method according to the embodiment. More specifically, openings 62*b* and 64*b* having nearly the same shape as the opening in the second plate metal member 12 in FIG. 1 and is formed in the upper portion of the right and left side plates 62 and 64 (corresponds to 12*a* in FIG. 1, and portions corresponding to the pressing portion 14 in FIG. 1 are also provided in the openings 62*b* and 64*b*). Further, in both sides of the upper holding member 66, a connecting portion 66*a* (corresponds to 10*a* in FIG. 1) having nearly the same shape as the connecting portion in the first plate metal member 10 and a perpendicularly bent portion 66*b* (corresponds to 10*b* in FIG. 1) are formed. Then the upper holding member 66 is combined to the right and left side plates 62 and 64 by pressing the connecting portion 66*a* of the upper supporting portion 66 into the openings 62*b* and 64*b* of the right and left side plates 62 and 64 in the state as shown in FIG. 2. In this combined state, the connecting portion 66*a* of the upper holding member 66 is pressed against the position deciding surface of the openings 62*b* and 64*b* (corresponds to 12*b* in FIG. 2) as in the case shown in FIG. 2, therefore, the upper holding member 66 is precisely decided its vertical position with respect to the right and left side plates 62 and 64, and combined. As for position in the back and forth direction, it is decided by fitting the connecting portion 66*a* into the openings 62*b* and 64*b* in the back and forth direction.

Similarly, openings 62*c* and 64*c* (corresponds to 12*a* in FIG. 1, and portions corresponding to the pressing portion 14 in FIG. 1, are also formed in the openings 62*c* and 64*c*) having nearly the same shape as in the second plate metal member 12 shown in FIG. 1 are formed in lower portion of the right and left side plates 62 and 64. Further, connecting portions 68*a* (corresponds to 10*a* in FIG. 1) and perpendicularly bent portions 68*b* (corresponds to 10*b* in FIG. 1), having nearly the same shape as in the first plate metal member 10, are formed in both edges of the lower holding member 68. Then, by pressing the connecting portions 68*a* of the lower holding member 68 into the openings 62*c* and 64*c* of the right and left side plates 62 and 64 in a state as shown in FIG. 2, the lower holding member 68 is combined to the right and left side plates 62 and 64. In this combined state, similarly to the state shown in FIG. 2, the connecting portions 68*a* of the lower holding member 68 are pressed against the reference surfaces (corresponds to 12*b* in FIG. 2) of the openings 62*c* and 64*c*, therefore the lower holding member 68 can be precisely decided its position in the right and left side plates 62 and 64 in the vertical direction, and combined. Further, as for the front and rear direction, the position of the lower holding member 68 in the width direction is decided by fitting the supporting portions 68*a* into the openings 62*c* and 64*c*.

Note that, in the present embodiment, in order to improve the strength of the whole main body frame 60, the upper holding member 66 and the lower holding member 68 are fixed to the side plates 62 and 64 by screws or the like after the upper holding member 66 and the lower holding member 68 are pressed into the right and left side plates 62 and 64 as described above.

Next, the advantage of the combining method of the embodiment when the method is applied to the main body frame 60 of the LBP 20 will be explained.

In an copying process by a LBP, the required degree of tolerance of the light path length of the laser beam from the scanner unit 22 to the electrostatic drum 24 is, when a product which is under development is concerned, ±7 mm, calculated from the field depth of an optical element to be used in the LBP. This is based on that, if the tolerance of the light path length is ±0, an image of the highest tolerance can be obtained when the light spot diameter of a laser beam becomes minimum, and as the tolerance increases, the light spot diameter on the surface of the electrostatic drum 24 becomes larger and the resolution is lowered. Accordingly, regarding the aforesaid product, the required tolerance is calculated as ±7 mm.

Figure 8:
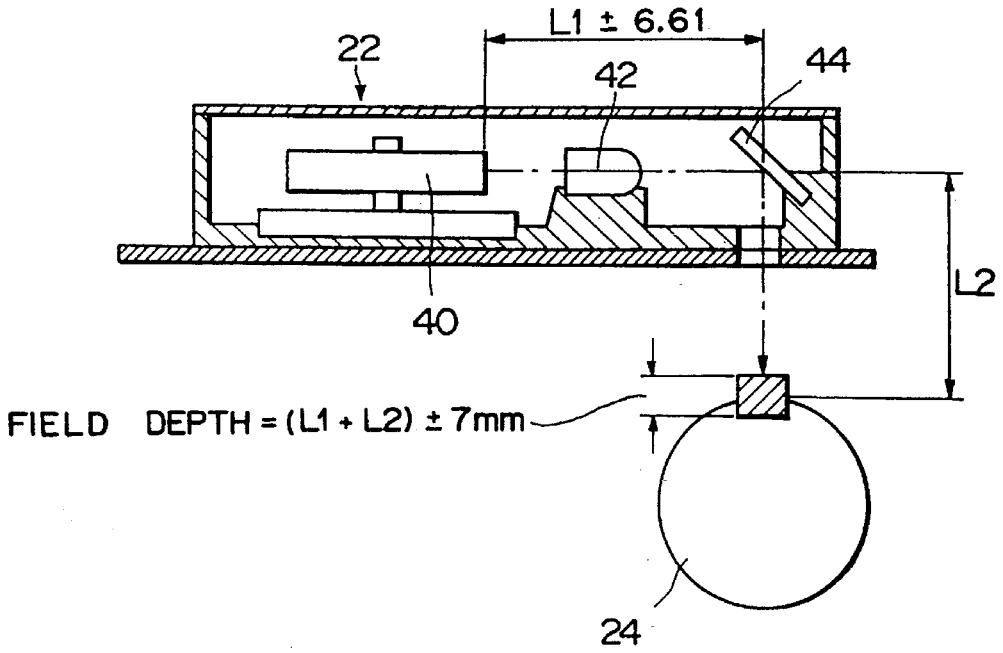
FIG. 8 is a figure illustrating a tolerance of the optical path length between a scanner unit and an electrostatic drum.

The above-described situation is shown in FIG. 8. In FIG. 8, the light path length from the polygon mirror 40 of the scanner unit 22 to the upper surface of the electrostatic drum 24 is (L1+L2), and the predetermined tolerance is ±7 mm as described above. When the tolerance is wider than the predetermined tolerance, the image cannot be focused well and it becomes impossible to satisfy the predetermined resolution. In the predetermined tolerance ±7 mm, the tolerance of the light path length L1 is ±6.61 mm which is caused by the unevenness, and the like, of parts inside the scanner unit 22. Therefore, the allowed tolerance in the main body frame L2 is ±0.39 mm.

Figure 9:
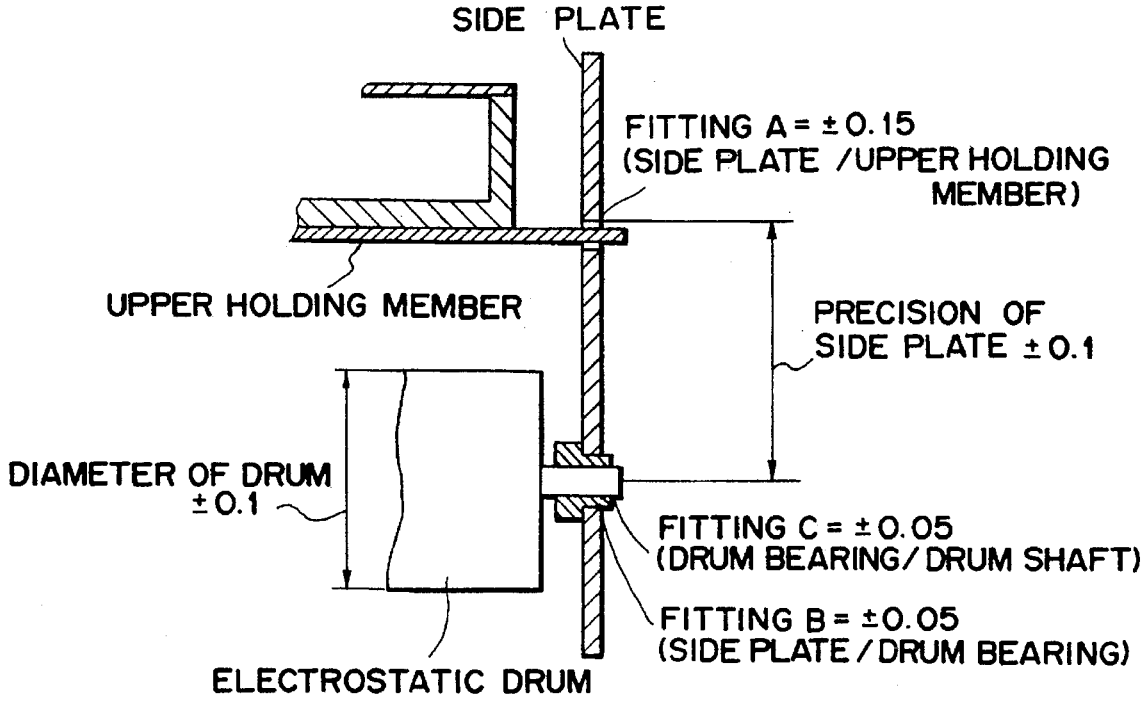
FIG. 9 is a figure illustrating a method of deciding relative position between a conventional side plate and an upper supporting member.

However, in the conventional method of deciding positions by fitting the upper supporting portion into the side plates, there is ±0.15 mm of fitting tolerance at the fitting portion A in the vertical direction, as shown in FIG. 9, thus it has been necessary to use an assembly set-up member for determining the precise positions for assembling, or the error of the light length L2 from the mirror 44 to the electrostatic drum 24 can not be within the standard tolerance ±0.39 mm, which causes the deterioration in resolution.

On the contrary, in a case where the combining method according to the embodiment is used ,the supporting portion 66*a* of the upper holding member 66 is precisely pressed against the reference surface (upper side of the holding holes 62*a* and 64*a*) of the holding holes 62*a* and 64*a* of the side plates 62 and 64, therefore the error in the vertical direction, which is conventionally ±0.15 mm, becomes 0. Accordingly, the degree of tolerance is improved. The differences of tolerance of the conventional example and of the embodiment are shown in FIG. 10. As shown in FIG. 10, it is not possible to satisfy the predetermined tolerance ±7 mm of the light path length without the assembly set-up member in the conventional example, whereas, according to the embodiment, the standard tolerance ±7 mm is satisfied without using the assembly set-up member or the like.

As described above, the degree of tolerance of the positions of the side plates 62 and 64 and the upper holding member 66 is improved, the resolution becomes higher compared to the conventional method, and it is possible to realize image forming in high precision. In addition, it is unnecessary to perform precise adjustments during assembly, thereby the following advantages are obtained in the manufacturing process.

(1) The number of steps used in the method of adjusting precisely can be reduced.

(2) An expensive adjusting member becomes unnecessary.

(3) Confirmation and inspection of the precision after the adjustment becomes unnecessary.

(4) Since unstable manual assembly (mistakes caused by carelessness and unskilled workers) does not occur, the quality of products can be stabilized.

Next, another advantage of the combining method according to the embodiment, when it is applied to the main body frame of the LBP, will be explained.

Figure 11A:
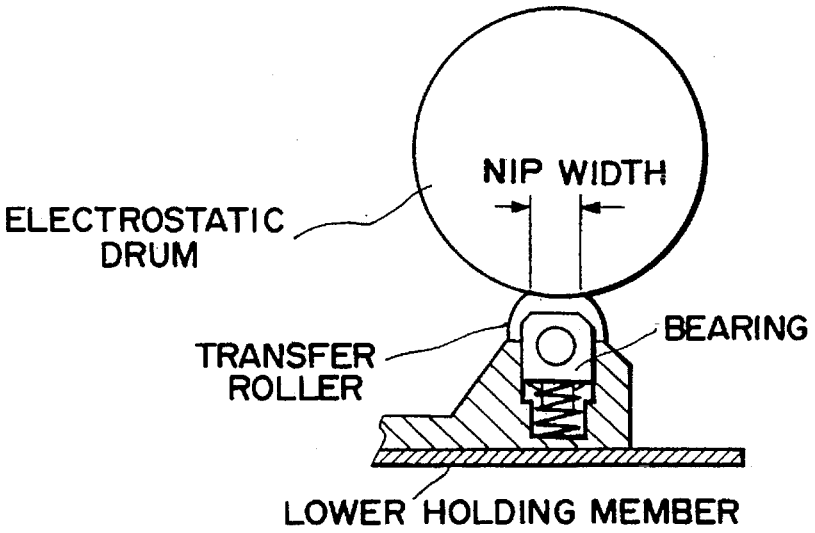
FIGS. 11A 11B are figures illustrating supporting structure of a conventional transfer roller.

Generally, the transfer roller of the LBP is pressed against the electrostatic drum with a certain force, and deformed to have the pressing width, so called "nip", as shown in FIG. 11A. The nip width is formed since the transfer roller is made of a spongy soft material. It causes the time to attract toner to be longer due to the broad portion contacting the electrostatic drum. With the effect of pressing the copying paper sheet P against the electrostatic drum, uniform transfer is performed.

Figure 11B:
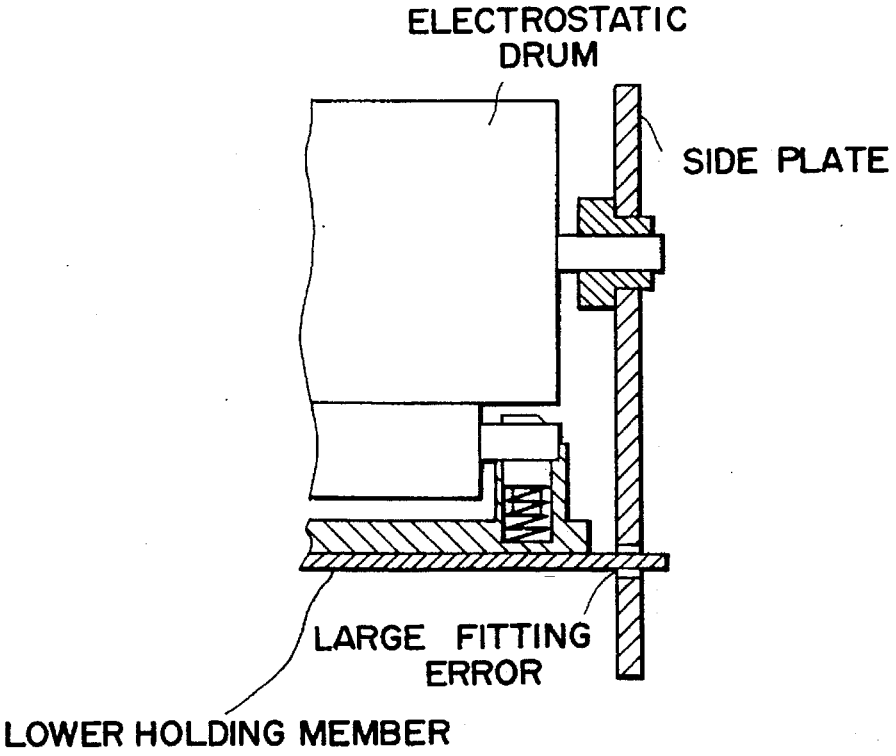
Figure 12:
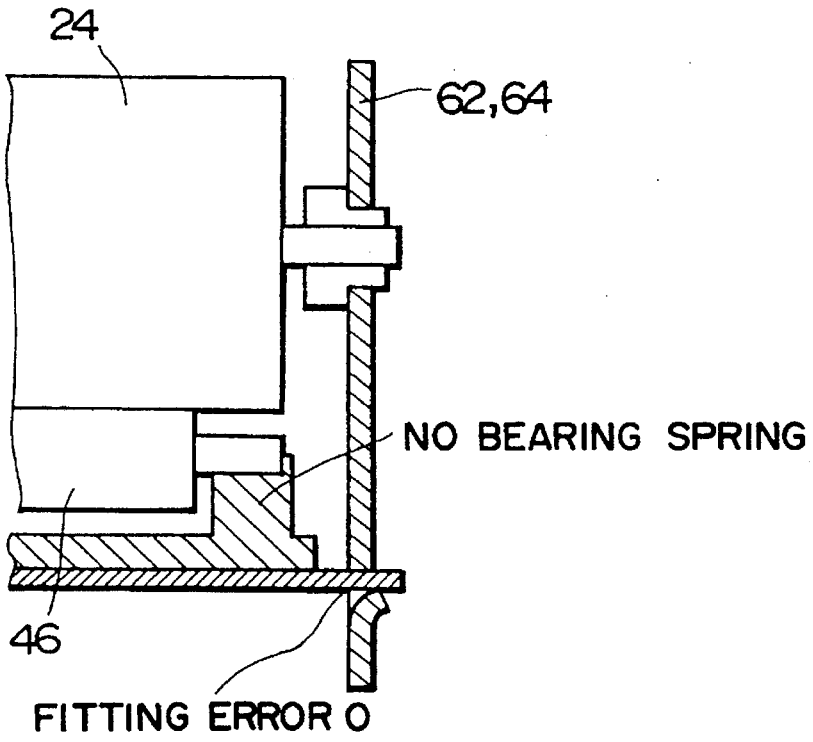
FIG. 12 is a figure illustrating a supporting structure of a transfer roller of the embodiment.

In order to press the transfer roller against the electrostatic drum, conventionally, the transfer roller is supported by a spring via a bearing and pressed against the electrostatic drum as shown in FIGS. 11A and 11B. In this configuration, similarly to the case of the scanner unit, since fitting error between the lower holding member and the side plates causes unevenness of the distance between the electrostatic drum and the transfer roller, a stable nip width can not be maintained with the transfer roller fixed.

On the contrary, when the combining method according to the embodiment is employed, the transfer roller 46 can be set at a fixed position by controlling the stiffness of the sponge of the transfer roller 46 since the positioning precision of the electrostatic drum 24 and the lower holding member 68 supporting the transfer roller 46 is improved.

Accordingly, by setting the transfer roller at the fixed position, following advantages can be obtained.

(1) The manufacturing cost can be reduced since the spring which supports the transfer roller can be removed.

(2) The error or malfunction caused by the transfer roller is reduced.

(3) A structure of supplying voltage to the transfer roller can be simplified, thereby the device becomes more reliable.

Next, another advantage of the combining method according to the embodiment, when it is applied to assemble the main body frame of the LBP, will be explained.

Figure 13:
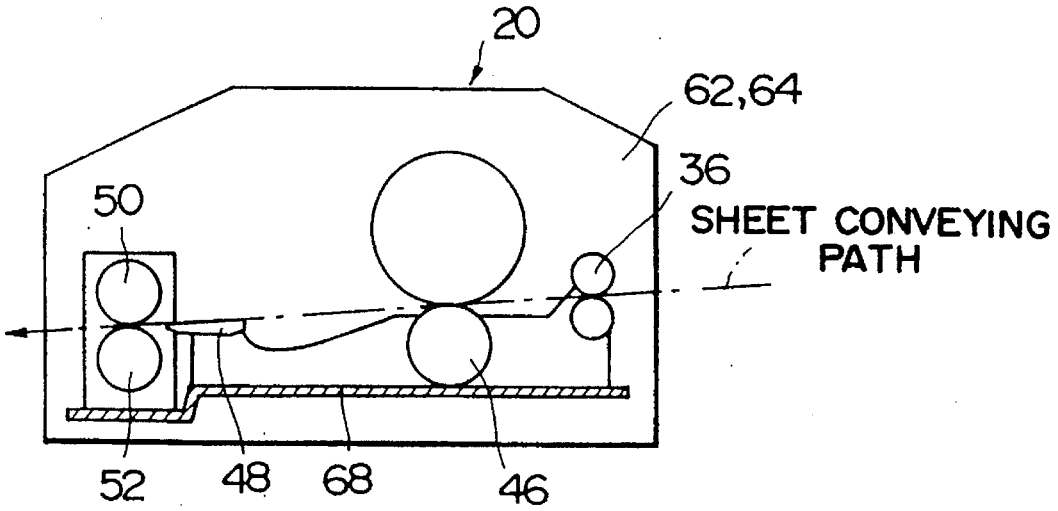
FIG. 13 is a figure showing a conveying path of a copy paper sheet in the LBP.
Figure 14:
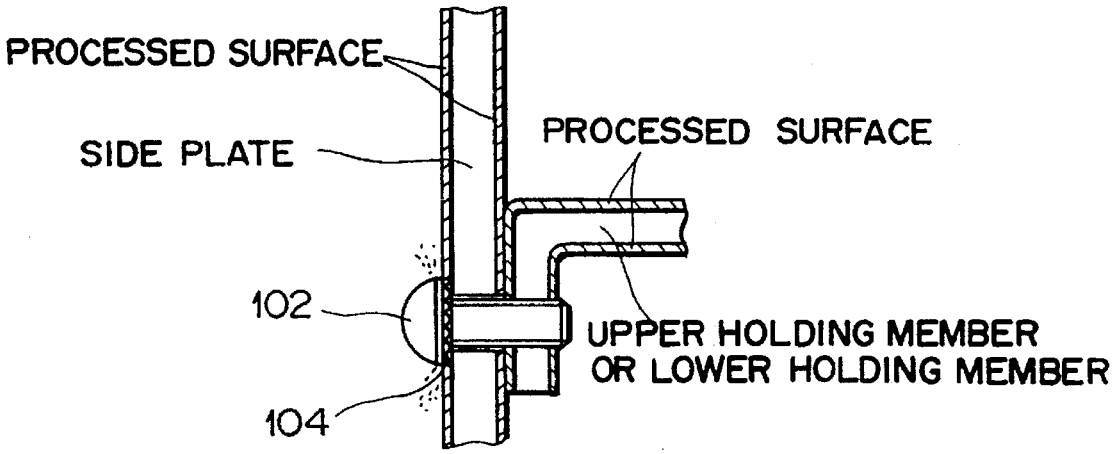
FIG. 14 is a figure showing a conventional method of conducting electricity among the side plate, upper and lower supporting members.
Figure 15:
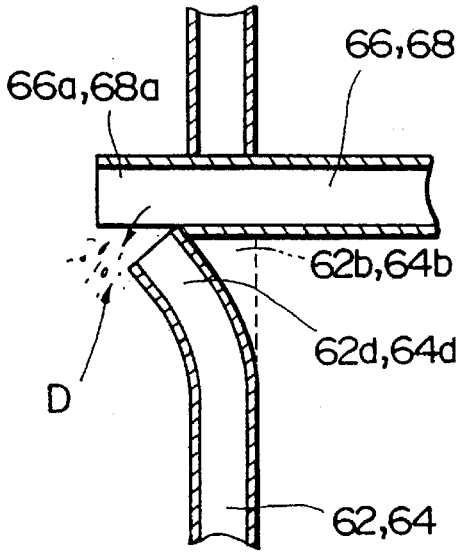
FIG. 15 is a figure showing a method of conducting electricity among the side plate, upper and lower supporting members according to the embodiment.
Figure 16:
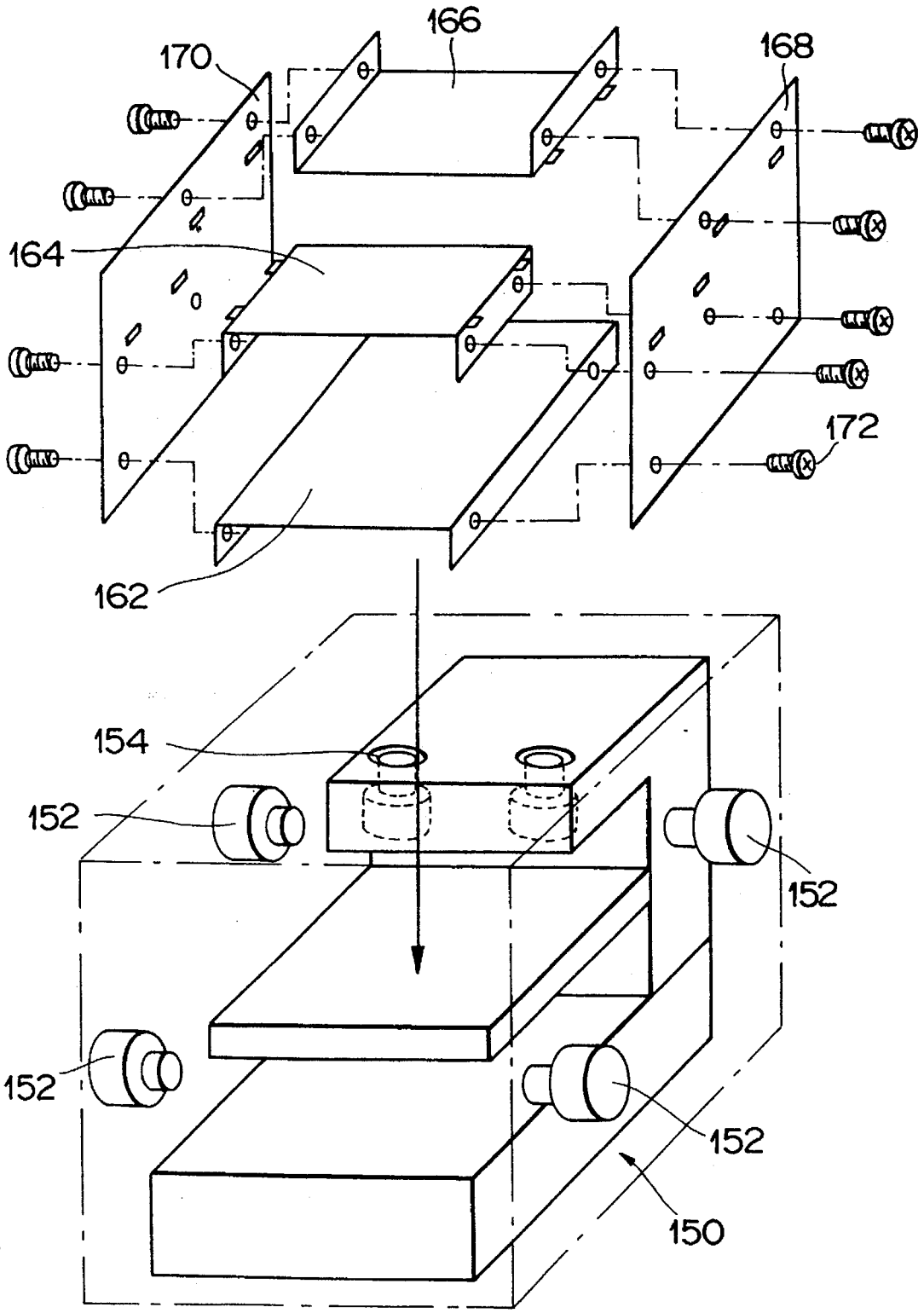
FIG. 16 is a figure showing a conventional process of assembling the main body frame with screws.

As shown in FIG. 13, the copying paper sheet P is fed from a paper feed unit (resist roller 36) to inside of the LBP 20, and conveyed along a path through the transfer roller 46, the paper sheet conveying unit, the fixing entrance guide 48, and the fixing roller 50. The resist roller 36, the transfer roller 46, the paper sheet conveying unit, the fixing entrance guide 48, and the fixing roller 50 are provided on the lower holding member 68. When the combining method according to the embodiment is employed to combine the lower holding member 68 and the side plates 62 and 64, the fitting error between the lower holding member 68 and the side plates 62 and 64 becomes 0, as already described. Therefore, the twist of the lower holding member 68 which is in between the right and left side plates 62 and 64 becomes very small, thus level of each unit of the portion conveying the copying paper sheet is improved, which is the best shape for conveying a paper sheet.

Accordingly, following advantages can be obtained.

(1) Paper jamming in the feeding and conveying paper sheet system can be prevented.

(2) Wrinkles on the paper sheet caused by being inserted in the fixing unit (the fixing roller and the pressing roller) slightly diagonally is prevented.

Further, another effect of the method according to the embodiment is that electrical conductance between the two plate metal members is easily obtained.

More specifically, in the main body frame of the LBP, the side plates, the upper holding member, and the lower holding member have to be electrically connected in order to be grounded. When a mechanical product is made with plate metal members in general, since surface-processed plate metal members are usually used, the surface procedure reduces the electrical conductivity the plate metal members are merely touching. Therefore, in order to electrically connect the side plates and the upper and the lower holding members, a jagged washer is conventionally put on a bolt 102 used for fixing the side plates and the upper and the lower holding members, so that the fringed washer 104 bites into the processed surface of the side plates. Accordingly, the side plates and the upper and the lower holding members are electrically connected via the jagged washer 104 and the bolt 102.

On the contrary, in the embodiment, the pressing portions 62*d* and 64*d* (corresponds to the pressing portion 14 in FIGS. 1 and 2) are formed in the openings 62*b* and 64*b* of the side plates 62 and 64, therefore the processed surfaces of the connecting portions 66*a* and 68*a* of the upper and the lower holding members 66 and 68 are carved by the pressing portions 62*d* and 64*d* as shown by an arrow D. Accordingly, the side plates and the upper and the lower holding members can be easily connected electrically.

According to the embodiment as described above, the combining process can be performed when the positions of members are made in high precision, only by pressing in the plate metal members into each other, thus a plate metal structure in high precision can be assembled without using a complicated assembly set-up member.

Further, the combining force between each element is strong when the combining method according to the embodiment is used (having characteristics of setting the combining force in a certain degree of freedom in accordance with the shape of the pressing portion 14), thus the method can be further developed into a screwless combining method.

Note, the aforedescribed embodiment can be modified within the spirit and scope of the present invention.

For example, in the above embodiment, the connecting portions (66*a* and 68*a*) are formed on both sides of the upper and the lower holding members, and the openings as shown by 12*a* in FIG. 1 are formed in both the right and left side plates. However, when a plate metal frame which is allowed to have larger assembly tolerance is manufactured, the method according to the embodiment can be applied to one of the right or left sides of the holding members and the side plates, and at the other side the conventional method can be used. When a higher precision is required to assemble a frame, and when the assembling process has to be simplified, it is preferred to apply this method according to the embodiment to both the right and left side plates as described in the embodiment.

As described above, according to the structure of the image forming apparatus of the embodiment, the positions of the optical unit, the transfer unit, fixing unit, and electrostatic unit can be assembled with high precision without using an assembly set-up member or the like.

The present invention is not limited to the above embodiments and various changes and modifications can be made within the spirit and scope of the present invention. Therefore to appraise the public of the scope of the present invention, the following claims are made.

What is claimed is:

1. A structure of an image forming apparatus which has at least an optical unit, comprising:

a first side member;

a second side member; and a holding member for supporting the optical unit, wherein said holding member has a nearly perpendicularly bent portion on at least one edge of said holding member and a connecting portion, extended from a base of said bent portion, for connecting said first and second side members, and wherein said first and second side members have openings into which said connecting portion of said holding member is inserted and an elastic portion for pressing said inserted connecting portion against the openings, further wherein said holding member is aligned in place at reference positions of the openings of said first and second side members by inserting said connecting portion of said holding member into the openings of said first and second side members.

2. The structure of an image forming apparatus according to claim 1, wherein said first and second side members have rotational supporting units which determine the reference axis of an electrostatic drum of the image forming apparatus, and the position of said holding member is determined based on positions of the openings with respect to said rotational supporting units.

3. The structure of an image forming apparatus according to claim 1, wherein said first and second side members have horizontal surfaces parallel to a horizontal reference surface in the base of the image forming apparatus, and the openings of said first and second side members are formed tilted with respect to said horizontal surfaces.

4. The structure of an image forming apparatus according to claim 1, wherein, in the center portions of the openings of said first and second side members into which said connecting portion of said holding member is inserted, concave portions are formed.

5. A structure of an image forming apparatus which has at least an image transfer unit, comprising:

a first side member;

a second side member; and a holding member for supporting the image transfer unit, wherein said holding member has a nearly perpendicularly bent portion on at least one edge of said holding member and a connecting portion, extended from a base of said bent portion, for connecting said first and second side members, and wherein said first and second side members have openings into which said connecting portion of said holding member is inserted and an elastic portion for pressing said inserted connecting portion against the openings, further wherein said holding member is aligned in place at reference positions of the openings of said first and second side members by inserting said connecting portion of said holding member into the openings of said first and second side members.

6. The structure of an image forming apparatus according to claim 5, wherein said first and second side members have rotational supporting units which determine the reference axis of an electrostatic drum of the image forming apparatus, and the position of said holding member is decided based on positions of the openings with respect to said rotational supporting units.

7. The structure of an image forming apparatus according to claim 5, wherein, in the center portions of the openings of said first and second side members into which said connecting portion of said holding member is inserted, concave portions are formed.

8. A structure of an image forming apparatus which has at least an image fixing unit, comprising:

a first side member;

a second side member; and a holding member for supporting the image fixing unit, wherein said holding member has a nearly perpendicularly bent portion on at least one edge of said holding member and a connecting portion, extended from a base of said bent portion, for connecting said first and second side members, and wherein said first and second side members have openings into which said connecting portion of said holding member is inserted and elastic portions for pressing said inserted connecting portion against the openings;

further wherein said holding member is aligned in place at reference positions of the openings of said first and second side members by inserting said connecting portion of said holding member into the openings of said first and second side members.

9. The structure of an image forming apparatus according to claim 8, wherein, in center portions of the openings of said first and second side members into which said connecting portion of said holding member is inserted, concave portions are formed.

10. A structure of an image forming apparatus which has an optical unit inside of a main body, comprising:

a pair, right and left side, of members; and a holding member, placed between said pair of right and left side members, for supporting the optical unit, wherein said holding member has a bent portion at at last one edge of said holding member and a connecting portion extended from said bent portion, and wherein said pair of right and left side members have openings into which said connecting portion of said holding member is inserted and pressing portions for pressing said connecting portion against the openings when said connecting portion is inserted into the openings.

11. The structure of an image forming apparatus according to claim 10, wherein a reference position corresponding to a central axis of a supporting shaft of an electrostatic member which receives light image signals from the optical unit is set in said pair of right and left side members, and positions of the openings of said pair of right and left side members are set at a predetermined distance from the reference position.

12. The structure of an image forming apparatus according to claim 10, wherein, in center portions of the openings of said first and second side members into which said connecting portion of said holding member is inserted, concave portions are formed.

13. A structure of an image forming apparatus which has an image transfer unit inside of a main body, comprising:

a pair of right and left side members; and a holding member, placed between said pair of right and left side members, for supporting the image transfer unit, wherein said holding member has a bent portion at at least one edge of said holding member and a connecting portion extended from said bent portion, and wherein said pair of right and left side members have openings into which said connecting portion of said holding member is inserted and pressing portions for pressing said connecting portion against the openings when said connecting portion is inserted into the openings.

14. The structure of an image forming apparatus according to claim 13, wherein a reference position corresponding to a central axis of a supporting shaft of an electrostatic member which receives light image signals from an optical unit is set in said pair of right and left side members, and positions of the openings of said pair of right and left side members are set at a predetermined distance from the reference position.

15. The structure of an image forming apparatus according to claim 13, wherein, in center portions of the openings of said first and second side members into which said connecting portion of said holding member is inserted, concave portions are formed.

16. A structure of an image forming apparatus which has an image fixing unit inside of a main body, comprising:

a pair of right and left side members; and a holding member, placed between said pair of right and left side members, for supporting the image fixing unit, wherein said holding member has a bent portion at at least one edge of said holding member and a connecting portion extended from said bent portion, and wherein said pair of right and left side members have openings into which said connecting portion of said holding member is inserted and pressing portions for pressing said connecting portion against the openings when said connecting portion is inserted into the openings.

17. The structure of an image forming apparatus according to claim 16, wherein a reference position corresponding to a central axis of a supporting shaft of an electrostatic member which receives light image signals from an optical unit is set in said pair of right and left side members, and positions of the openings of said pair of right and left side members are set at a predetermined distance from the reference position.

18. The structure of an image forming apparatus according to claim 16, wherein, in center portions of the openings of said first and second side members into which said connecting portion of said holding member is inserted, concave portions are formed.

* * * * *

UNITED STATES PATENT AND TRADEMARK OFFICE

CERTIFICATE OF CORRECTION

PATENT NO. : 5,570,159

DATED : October 29, 1996

INVENTOR(S) : Hirose et al.

It is certified that error appears in the above-indentified patent and that said Letters Patent is hereby corrected as shown below:

In the drawings:

SHEET 9:

FIG. 10, "TORELANCE" should read --TOLERANCE--.

COLUMN 12:

Line 47, "last" should read --least--.

Signed and Sealed this

Twenty-ninth Day of April, 1997

Bruce Lehman

*Attest:*

BRUCE LEHMAN

*Attesting Officer*

*Commissioner of Patents and Trademarks*